United States Patent [19]

McKee

[11] Patent Number: 4,522,408

[45] Date of Patent: Jun. 11, 1985

[54] PEG BOARD GAME APPARATUS

[76] Inventor: David M. McKee, 169 Cannon Dale Rd., Columbia, S.C. 29210

[21] Appl. No.: 585,270

[22] Filed: Mar. 1, 1984

[51] Int. Cl.[3] ..... A63F 3/00

[52] U.S. Cl. ..... 273/271; 273/282

[58] Field of Search ..... 273/271, 282 C, 290; 434/195, 196, 259

[56] References Cited

U.S. PATENT DOCUMENTS

| | | | |
|---|---|---|---|
| 680,324 | 8/1901 | Gedge | 273/271 |
| 1,151,279 | 8/1915 | Lewis | 434/195 |
| 3,194,560 | 7/1965 | White | 273/282 C X |
| 3,558,137 | 1/1971 | Progin | 273/290 X |
| 3,603,591 | 9/1971 | Shoptaugh | 273/282 C X |
| 3,834,708 | 9/1974 | Shoptaugh | 273/282 C X |
| 4,239,230 | 12/1980 | Shoptaugh | 273/271 X |
| 4,462,596 | 7/1984 | Yamamoto | 273/290 X |

*Primary Examiner*—Harland S. Skogquist

[57] ABSTRACT

A board game having playing fields arranged in rows and columns, each playing field having a hole adapted to receive four types of playing pieces. The first type of playing piece comprising a peg of a length equal to the depths of the holes; the second type of playing piece being shorter than the first and the third type of playing piece having a length equal to the difference in length between the first and second types of playing pieces. The fourth type of playing piece comprises a sphere of diameter equal to the difference in length between the first and second type of playing piece. Board holes are of sufficient depth to naturally obscure playing pieces of the fourth type in darkness when positioned on the bottom of the holes. The tops of playing pieces of the first and second type project above, below or even with the board surface depending on the number of the fourth type of playing pieces already in the hole. Playing pieces of the first and second type display a circular area of color when positioned even with the board surface or display differing color bands on the sides when projected above the board surface. Playing pieces of the third type display one color as a circular area and are played only in combination with playing pieces of the second type.

6 Claims, 4 Drawing Figures

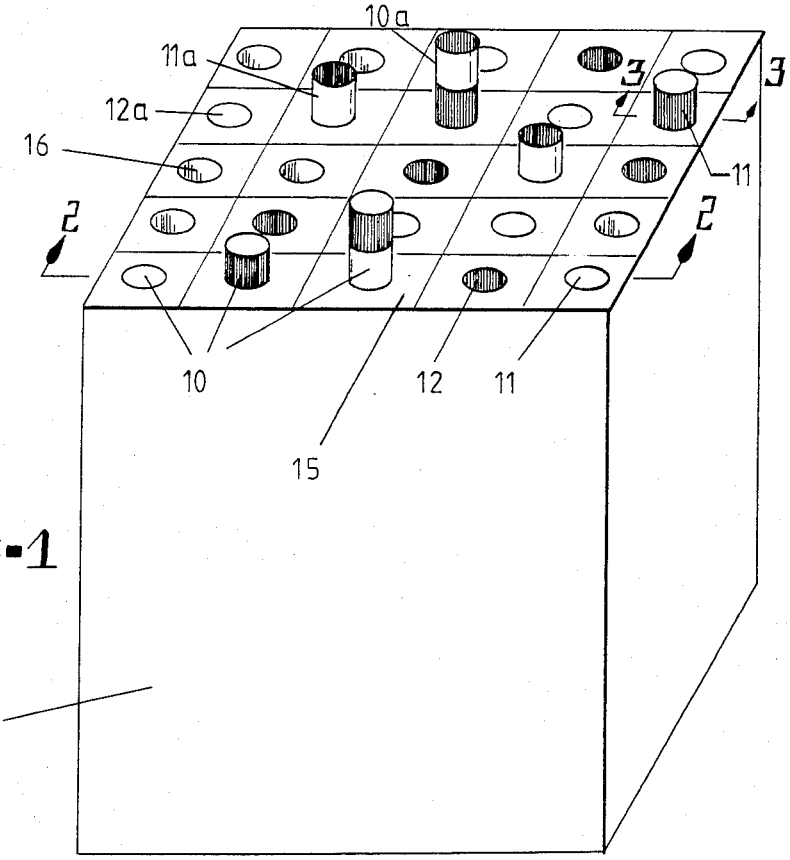
FIG-1
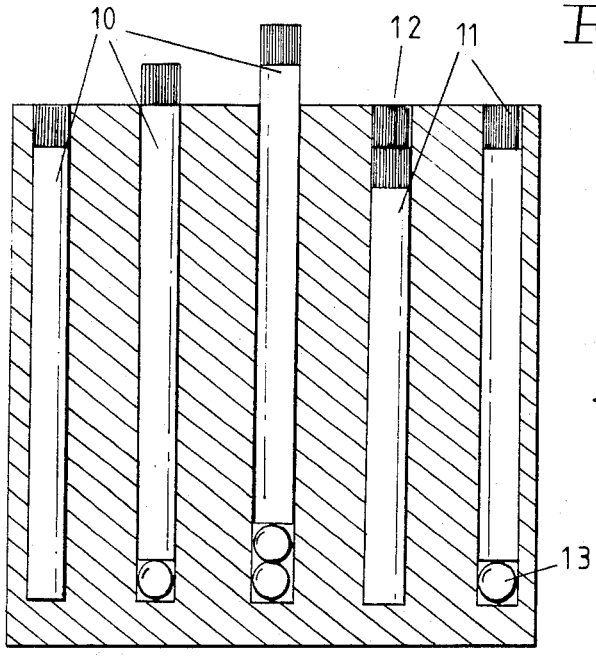
FIG-2
FIG-3
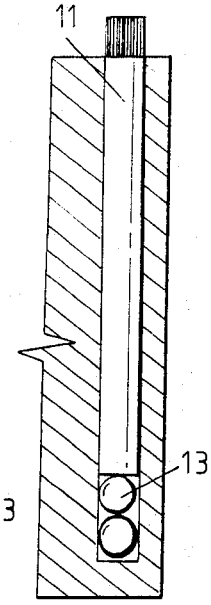

PEG BOARD GAME APPARATUS

DESCRIPTION

1. Technical Field

This invention relates to a game apparatus of the tick-tack-toe type which may be played by two or more people on a board which allows placement of hidden pieces prior to play.

2. Background Art

U.S. Pat. No. 3,891,219 discloses a peg board game in which playing pins with colored shafts are mounted to slide in holes with different colored surfaces. Thus, upward or downward movement of the pins results in the display of two different colors, respectively. Although the feature of mounted playing pins eliminates the need for handling many pieces, the play of the game remains essentially simple.

Peg board games have also been provided in the past which allow the players to hide pieces in the board thus affecting the outcome of future play. One type of peg board game which features the "surprise" element is disclosed in U.S. Pat. No. 3,558,137. In this game pawns are first hidden on one side of each players respective half of the board. Insertion of subsequent playing pieces on the other sides that fail to mate with the hidden pawns results in the pieces partially filling the holes. As a result, the playing pieces project above the board becoming highly noticeable and subject to elimination from the game. The disadvantages of this game are that the players can only hide pawns on their respective halves of the playing board and that the board is comprised of two plates which must be separated and then reunited before play.

It is therefore the object of this invention to improve the above mentioned types of games by introducing the element of surprise in a new manner. A novel board is provided which allows the players to hide pieces anywhere on a single board.

Yet another object of this invention is to provide the means whereby two players can hide playing pieces in the same location without the others knowledge.

Still another object of this invention is to provide novel playing pieces with colored patterns allowing the possibility of several different events for every play.

These and other objects and advantages of the invention will appear more clearly from the following specifications in connection with the accompanying drawing.

DESCRIPTION OF THE DRAWING

FIG. 1 is a perspective view of the entire playing board of the present invention.

FIG. 2 is a cross-section view taken along lines 2—2 of FIG. 1, showing five of the six possible combinations of playing pieces that can occur every time a player moves.

FIG. 3 is a cross-section view taken along lines 3—3 of FIG. 1 showing the remaining sixth possible combination not shown in FIG. 2.

Referring to FIG. 4, the first type of playing piece is an elongated peg 10; the second type is an elongated peg 11 which is shorter than the first elongated peg 10; the third type of playing piece is a very short peg 12 and the fourth type of playing piece is a ball 13. Playing pieces 10*a*, 11*a* and 12*a* are also shown to represent the opponents playing pieces which are dimensionally identical with playing pieces 10, 11 and 12 but carry the reverse color pattern. The ball 13 is of any given color common to both players.

DETAILED DESCRIPTION OF THE PREFERRED EMBODIMENT

Figure 4:
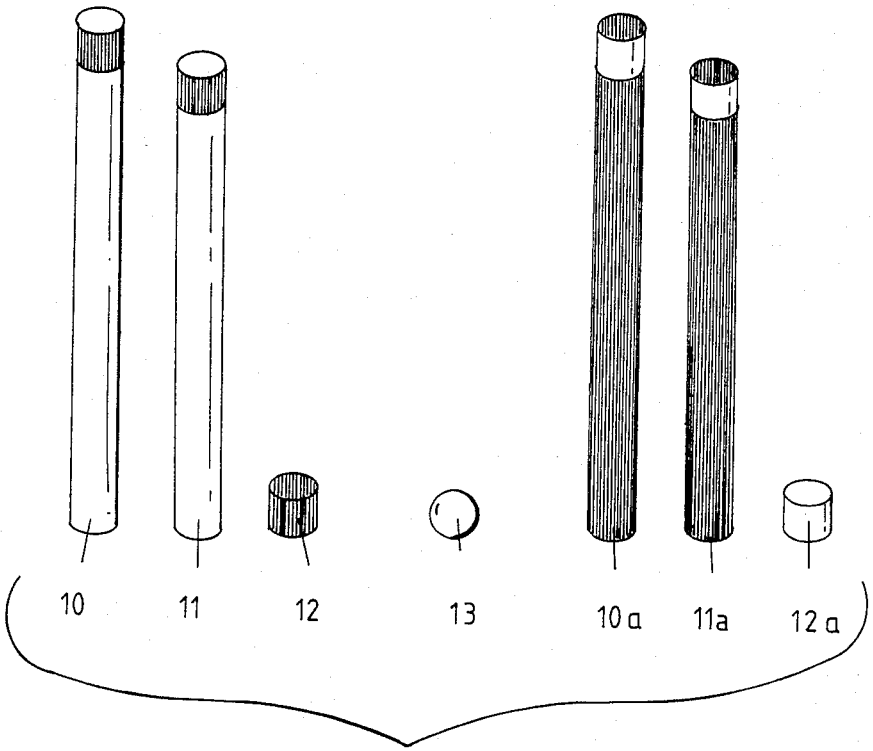
FIG. 4 is a perspective view of the four types of playing pieces used by each player.

The game illustrated comprises a block type board 14 with a 5×5 checker board array of playing fields 15 on one side. Such playing fields 15 may be conventional checkerboard squares or a plurality of circular or other shaped areas aligned in rows or columns. The playing fields 15 each comprise a hole 16 of given diameter and of sufficient depth to hide balls 13 in darkness when one or two of such balls are dropped to the bottom of the hole 16.

Pegs 10 (10*a*), 11 (11*a*) and 12 (12*a*) are right cylinders of a given equal diameter such that they will easily slide in and out of the holes 16.

The length of pegs 10 (10*a*) is equal to the depth of the holes 16.

The length of pegs 11 (11*a*) is less than pegs 10 (10*a*).

The length of pegs 12 (12*a*) is equal to the difference in length between pegs 10 (10*a*) and 11 (11*a*).

The diameter of balls 13 is also equal to the difference in length between pegs 10 (10*a*) and 11 (11*a*).

The pegs 10 and 11 are of a first color with a band of a second color covering an annular area at the end of the pegs. Similarly, pegs 10*a* and 11*a* are of a second color with a band of the first color covering an annular area at the end of the pegs. The width of the color band is equal to the difference in length between peg 10 (10*a*) and 11 (11*a*).

Pegs 12*a* and (12) are of the first and second color respectively.

Although a playing board having playing fields comprising cylindrical holes and playing pieces which are cylindrical or spherical bodies are preferred, the holes may have any cross sectional configuration dimensioned to receive the playing pieces and the playing pieces may have any cross sectional configuration dimensioned to be received in the holes.

The game is played as follows: Each player takes five balls 13 and hides them in holes 16 unknown to his opponent. Only one ball 13 may be hidden per hole 16 by a single player. Next, the players select their color of pegs and begin taking turns placing the pegs 10 (10*a*) or 11 (11*a*) in the holes 16. Twelve pegs 10 (10*a*) and eight pegs 11 (11*a*) are supplied to each player. The object of the game is to gain possession of as many rows of four or five squares as possible. Rows may run horizontally, vertically, diagonally and may intersect. One point is assigned to each square in a row. The above rules are not essential according to the teachings of this invention and interesting methods of play may be devised without such rules.

The pegs 10 (10*a*) will fit exactly in the holes 16 so that the end of the pegs will be even with the edge of the holes 16 thus displaying the chosen color as a circular area. However, if a peg 10 (10*a*) is placed in a hole 16 containing a hidden ball 13, the peg 10 (10*a*) will project upward a distance of one color band width displaying the opponents color band next to the edge of the hole. When this happens the opponent gains possession of that square.

Pegs 11 (11*a*) are played when the player knows that there is a h1dden ball 13 in a hole 16 or suspects that his opponent has hidden one. When pegs 11 (11*a*) are thus played and a hidden ball 13 is actually in the hole 16, then the top of the peg 11 (11*a*) will be even with the edge of the hole 16 thus successfully displaying the chosen color as a circular area.

If, on the other hand, a player places a peg 11 (11*a*) in a hole 16 that does not contain a hidden ball 13, the peg 11 (11*a*) will drop down into the hole 16. This constitutes loss of possession of the square and the player must fill the hole 16 with a peg 12 (12*a*) so that the opponents color is displayed as a circular area which is even with the edge of the hole.

Two other possible events can occur for the situation when two balls 13 are hidden in the same hole 16 (one ball 13 hidden by each player). Playing peg 10 (10*a*) in this situation results in the peg projecting upward a distance equal to two color band widths. Thus the chosen color is displayed next to the edge of the hole and the player successfully retains possession. Playing peg 11 (11*a*) in the above situation would result in the peg 11 (11*a*) projecting upward a distance of one color band width thus displaying the opponents color band next to the edge of the hole 16. The player would therefore lose possession of the square to his opponent.

I claim:

1. In a game, the combination comprising:

(a) two sets of playing pieces each, to be used by one of two players, means distinguishing one set from the other, each set comprising playing pieces of a first, second, third and fourth type;

(b) said first, second, third and fourth types of playing pieces having a cross sectional configuration of given maximum external dimension and lengths;

(c) said playing piece of the second type having a length less than the said playing piece of the first type;

(d) said playing pieces of the third and fourth type having a length equal to the difference in length between the said first and second playing pieces;

(e) said first and second types of playing pieces each having a top color and sides patterned with both said top color and a second color;

(f) said third type of playing piece being of either said top color or said second color;

(g) a playing board to be used by players, means carried on top side dividing said top side into a plurality of parallel rows and parallel columns defining a plurality of playing squares, each of said squares including a formed hole dimensioned to receive any playing piece of said first, second, third or fourth type, each of said holes having depth dimensions equal to the length of said first type of playing piece, each of said holes also having a depth dimension sufficient to naturally obscure one or two of said fourth types of playing pieces in darkness when said fourth type of playing pieces are positioned on the bottom of said holes, whereby playing pieces of said first and second type positioned in said holes independently or in combination with said playing pieces of the said third and fourth type will display a top color even with said board surface or project above said board surface displaying a pattern of said top color and a second color, respectively.

2. A combination as claimed in 1 wherein said hole of each playing field has a right circular cylindrical configuration of given diameter.

3. A combination as claimed in 1 wherein each of said playing pieces of the first, second and third type comprises a peg of given circular cross-section and given length.

4. A combination as claimed in 1 wherein said sides patterned with both said top color and a second color comprising annular bands of said top and second color, each said band having a width equal to the difference in length between said first and second types of playing pieces.

5. A combination as claimed in 1 wherein said playing pieces of the fourth type comprising a sphere with a diameter equal to the difference in length between the said first and second playing pieces.

6. A combination as claimed in 1 wherein said means distinguishing one set from the other being a top color carried by said first and second types of playing pieces of the first set and said second color being carried on the top of said playing pieces of the first and second type of the second set.

* * * * *